US011280510B2

(12) United States Patent
Chatwin et al.

(10) Patent No.: US 11,280,510 B2
(45) Date of Patent: Mar. 22, 2022

(54) CLIMATE CONTROLLER THAT DETERMINES OCCUPANCY STATUS FROM BAROMETRIC DATA

(71) Applicant: ANACOVE, LLC, La Jolla, CA (US)

(72) Inventors: Alistair Ian Chatwin, Highlands Ranch, CO (US); Ian Amihay Lerner, La Jolla, CA (US); Roswell Reid Roberts, III, San Diego, CA (US); Carlos Shteremberg, La Jolla, CA (US)

(73) Assignee: ANACOVE, LLC, La Jolla, CA (US)

( * ) Notice: Subject to any disclaimer, the term of this patent is extended or adjusted under 35 U.S.C. 154(b) by 0 days.

(21) Appl. No.: 16/991,941

(22) Filed: Aug. 12, 2020

(65) Prior Publication Data

US 2022/0049870 A1 Feb. 17, 2022

(51) Int. Cl.

| | |
|---|---|
| ***F24F 11/46*** | (2018.01) |
| ***F24F 11/37*** | (2018.01) |
| *F24F 110/40* | (2018.01) |
| *F24F 120/12* | (2018.01) |

(52) U.S. Cl.

CPC ..... *F24F 11/46* (2018.01); *F24F 11/37* (2018.01); *F24F 2110/40* (2018.01); *F24F 2120/12* (2018.01)

(58) Field of Classification Search

CPC ..... F24F 2110/40

See application file for complete search history.

(56) References Cited

U.S. PATENT DOCUMENTS

| | | | | |
|---|---|---|---|---|
| 7,918,406 | B2 | 4/2011 | Rosen | |
| 9,459,018 | B2 | 10/2016 | Fadell et al. | |
| 9,618,222 | B1 | 4/2017 | Hussain et al. | |
| 9,945,574 | B1 * | 4/2018 | Sloo | F24F 11/30 |
| 10,048,706 | B2 | 8/2018 | Hublou et al. | |
| 10,067,516 | B2 | 9/2018 | Ramagem et al. | |
| 10,162,327 | B2 | 12/2018 | Sinha et al. | |
| 10,310,477 | B2 | 6/2019 | Sinha et al. | |
| 10,318,266 | B2 | 6/2019 | Ribbich et al. | |
| 10,484,478 | B2 | 11/2019 | Brophy et al. | |
| 10,559,045 | B2 | 2/2020 | Bentz et al. | |

(Continued)

*Primary Examiner* — Nathan L Laughlin

(74) *Attorney, Agent, or Firm* — Arc IP Law, PC; Joseph J. Mayo

(57) ABSTRACT

A climate control system that detects presence of a person in a room by analyzing small fluctuations in barometric pressure due to breathing. When the room is occupied, thermostatic control by the occupant may be enabled; when unoccupied, HVAC systems may be set to a low-power state. Barometric data may be processed using a bandpass filter that passes frequencies that correspond to typical human respiration rates. Barometric data may be used to determine when doors or windows are open or closed. Embodiments may connect to property management systems determine whether occupants are expected; when a room unoccupied but an occupant is expected, HVAC systems may be set to a standby state that saves power but allows temperature to return quickly to desired levels when a person enters the room. Occupancy detection may also use data from other sensors such as gas analyzers that detect compounds in exhaled breath.

14 Claims, 9 Drawing Sheets

(56) References Cited

U.S. PATENT DOCUMENTS

| | | | | |
|---|---|---|---|---|
| 2006/0186214 | A1* | 8/2006 | Simon | G05D 23/1902 236/1 C |
| 2015/0088272 | A1 | 3/2015 | Drew | |
| 2015/0168003 | A1* | 6/2015 | Stefanski | F24F 11/70 165/237 |
| 2016/0061469 | A1* | 3/2016 | Albonesi | H02J 3/14 700/276 |
| 2016/0327921 | A1 | 11/2016 | Ribbich et al. | |
| 2017/0146261 | A1 | 5/2017 | Rogers et al. | |
| 2017/0336770 | A1 | 11/2017 | MacMillan | |
| 2018/0087793 | A1 | 3/2018 | Okita et al. | |
| 2020/0348388 | A1* | 11/2020 | Jaynes | H04W 24/08 |
| 2021/0134454 | A1* | 5/2021 | Larson | A61B 5/6801 |
| 2021/0190355 | A1* | 6/2021 | Tokudi | F24F 11/48 |

* cited by examiner

Occupied

Unoccupied

CLIMATE CONTROLLER THAT DETERMINES OCCUPANCY STATUS FROM BAROMETRIC DATA

BACKGROUND OF THE INVENTION

Field of the Invention

One or more embodiments of the invention are related to the fields of occupancy sensors and climate control systems. More particularly, but not by way of limitation, one or more embodiments of the invention enable a climate controller that determines occupancy status from barometric data.

Description of the Related Art

A large component of the operational costs for lodging and institutions is the heating and cooling of the room in which a guest or resident resides. The individual, guest or resident, expects to be able to set their room to their desired temperature, achieving a comfortable living environment. However, the property manager does not want to have to pay for the convenience and comfort when the room is not occupied. Therefore considerable savings may be achieved if the occupancy status of a room can be determined, and if climate control systems can be turned off or set to low power modes when a room is unoccupied.

Typical in-room heating, ventilation, and air conditioning (HVAC) systems called Packaged Terminal Air Conditioners (PTAC) have a very basic control panel integrated into the unit. The individual is able to set the room temperature, but the unit is typically not connected to other devices to determine occupancy and thus reduce energy consumption. There are some retrofit systems that are added but their occupancy measurement is typically inaccurate, and systems are forced to assume occupancy overnight, thus consuming a lot more power than would be optimal.

Some properties have installed wall-mounted thermostats that may be connected to the in-room PTAC. A basic thermostat does not add any improvement to occupancy sensing. There are some thermostats that include a passive infrared (PIR) sensor to determine human movement. The PIR sensor does not do a good job sensing movement when a person is sleeping in the room. Thus, the room is unlikely to maintain the desired comfort required by the individual. This type of system will revert to time-based override during the night, yet again not achieving the optimal electricity savings available. The wired thermostat is expensive to retrofit to an existing building due to the wire installation process.

The newest evolution of in-room temperature control comes as four pieces to be installed. First this type of system needs the integrated controller to be updated to a compatible module. Next a small wireless module needs to be installed inside the front cover of the PTAC unit. A door switch needs to be installed on the exit of the room. A PIR sensor needs to be installed above the exit door. Then finally a battery powered thermostat needs to be installed on the wall. Even with all these items, occupancy sensing does not work very well as the bed is normally not in line of sight of the exit door.

In summary, existing solutions to occupancy detection for climate control systems are not very effective because they typically rely on motion sensors that provide incomplete information about whether a person is currently occupying a room.

For at least the limitations described above there is a need for a climate controller that determines occupancy status from barometric data.

BRIEF SUMMARY OF THE INVENTION

One or more embodiments described in the specification are related to a climate controller that determines occupancy status from barometric data. The controller may include or connect to a barometer that measures the air pressure of an indoor space, such as a hotel room. It may include a processor that receives air pressure data from the barometer, and that analyzes this data to determine the occupancy status of the space. This analysis may determine whether fluctuations in air pressure are indicative of one or more persons breathing in the space. The processor may transmit a control signal to a climate control system in or near the space based on the occupancy status determined from the air pressure data.

The climate control system may for example, without limitation, include any or all of a heater, an air conditioner, a heat exchanger, a humidifier, a dehumidifier, a fan, and a ventilation system. The indoor space may for example, without limitation, include any or all of a room or suite of one or more of a hotel, a motel, a lodge, a bed-and-breakfast, a vacation rental, a timeshare, an apartment building, and an office building.

When the occupancy status is unoccupied, the processor may send a control signal that sets the climate control system to low-power state. The control signal may also enable a user-controllable thermostat when the space is occupied, and disable the thermostat when the space is unoccupied.

In one or more embodiments, analysis of barometric data may include applying a filter to the air pressure data to obtain a signal magnitude in a frequency range that corresponds to human breath frequencies, and comparing this signal magnitude to a threshold. An illustrative frequency range may include frequencies between 0.1 Hertz and 1.0 Hertz. The threshold may be based on a comparison of the estimated volume of the indoor space to the estimated volume of a human breath.

In one or more embodiments, the processor may be connected to a property management system and may receive expected occupancy status information associated with the indoor space; the control signal transmitted to the climate control system may be based on the expected occupancy status in addition to being based on the occupancy status. For example, the control signal may set the power level of the climate control system to a low level when the space is unoccupied and no occupant is expected, and to a standby level when it is unoccupied and an occupant is expected. The standby level may for example enable the climate control system to drive the temperature of the indoor space to a target temperature within a target period of time.

In one or more embodiments the processor may receive sensor data from one or more additional sensors, such as for example, without limitation, a gas sensor, a user input device, or a wireless network interface. Occupancy status may be based on air pressure fluctuations as well as this additional sensor data.

In one or more embodiments, barometric data may be analyzed to detect the state of a window or door of the indoor space. For example, a window or door may be in an open state, a closed state, an opening state, or a closing state. The state of a window or door may also affect control signals sent to the climate control system.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A climate controller that determines occupancy status from barometric data will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
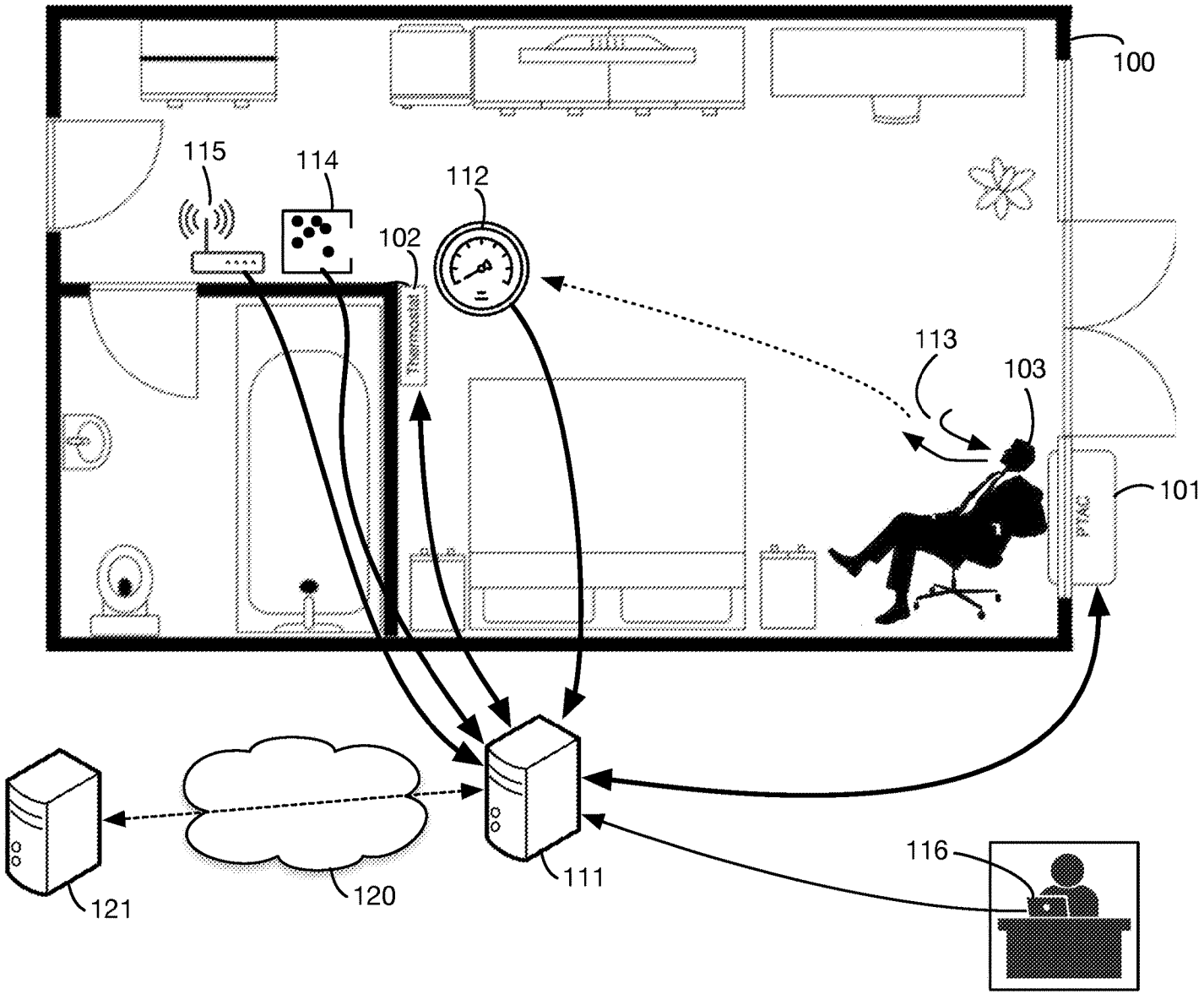
FIG. 1 illustrates an embodiment of the invention that controls climate for a hotel room by detecting occupancy from barometric pressure changes due to a person in the room breathing.

FIG. 1 shows an illustrative embodiment of the invention that controls the climate of a room 100. Room 100 may be for example a room, suite, or other indoor space in any type of building or facility, including for example, without limitation, a hotel, a motel, a motel, a lodge, a bed-and-breakfast, a vacation rental, a timeshare, an apartment building, or an office building. One or more embodiments of the invention may be used to partially or fully control any aspect of the climate of any indoor space or spaces. In one or more embodiments, the building or facility in which indoor space 100 is located may contain several such spaces, and instances of the invention may be installed on or proximal to multiple of these spaces within the building or facility.

Climate control may be achieved using any types of systems, modules, actuators, or sensors. For example, without limitation, climate control systems controlled by embodiments of the invention may include any or all of a heater, an air conditioner, a heat exchanger, a humidifier, a dehumidifier, a fan, and a ventilation system. In illustrative room 100, a heating, ventilation, and air conditioning (HVAC) system called a Packaged Terminal Air Conditioner (PTAC) 101 is installed in or near the room 100. In other indoor spaces, climate control modules may be located elsewhere in a facility; for example, there may be centralized heating or air conditioning systems and forced air ducts that control the climate of individual rooms. The modules of a climate control system may be packaged together or distributed throughout a room or a facility. One or more embodiments may control all of these modules or any subset of these modules.

In one or more embodiments of the invention, sensor data from one or more sensors in or near the indoor space 100 may be processed to determine whether the space is currently occupied by one or more persons. For example, the embodiment shown in FIG. 1 obtains data from a barometer (air pressure sensor) 112 in room 100. This barometer 112 may for example detect pressure changes due to the breath 113 of a person 103 in the room, as described below. Barometric data may be transmitted to one or more processors 111 for analysis. These processors may include for example, without limitation, a microprocessor, a microcontroller, an analog circuit, a digital signal processor, a CPU, a GPU, a laptop computer, a notebook computer, a tablet computer, a mobile phone or other mobile device, a desktop computer, a server computer, or any combination or network of any of these components. Processor or processors 111 may be located in room 100 or may be remote from room 100. Data may be transmitted from barometer 112 or other sensors to processor 111 via any type or types of link or network, including wired or wireless networks. In one or more embodiments, a local processor or processors 111 may communicate with one or more remote processors 121, for example over an Internet connection 120 or over another network. For example, some or all processing of sensor data may be performed on a cloud-based server 121, with results or control commands sent back from the server 121 to a local processor 111 to be used for climate control of space 100.

In one or more embodiments, additional sensors in or near room 100 may collect data that are transmitted to processor 111 for analysis of room occupancy or other conditions. For example, a gas sensor 114 may analyze the content of the air in the room. This analysis may be used for occupancy detection, since exhaled human breath contains a few thousand volatile organic compounds (VOCs) that can be detected to determine that a person is present in the room, or to determine the number of people in the room based on the concentration of VOCs. The gas sensor 114 may also be used to monitor air quality and freshness, and to alert occupants or facility staff of unsafe or uncomfortable conditions. Sensors may also include wireless access points or wireless signal detectors 115, which may determine that mobile devices of a user (such as a laptop or phone) are present in the room, which may be correlated with occupancy. Other occupancy sensors such as motion sensors, light sensors, or door switches may also be present and may transmit data to processor 111. Any devices in the room that accept user input, which indicates the presence of a person, may also transmit data to processor 111; these devices could include for example remote controls, a thermostat 102, or any other electronic device.

Once processor 111 (possibly in conjunction with remote processor or processors 121) has analyzed sensor data to determine occupancy, it may transmit climate control commands to a climate control system associated with the room. For example, the processor may directly control the PTAC 101 of the room, or it may control a thermostat 102 that may be linked to the PTAC or to other systems. If processor 111 determines that room 100 is unoccupied, it may for example shut off power or reduce power for room climate control systems to obtain energy savings when climate control is not needed.

In one or more embodiments, processor 111 may also be linked to a property management system (PMS) 116, such as a hotel booking system, and it may exchange data with such a system or systems. A property management system may be any system or database that contains or generates information about potential use or occupancy of the associated space. For example, system 116 may transmit reservation information to processor 111 that indicates during what time periods occupants are expected to be potentially present in the room 100. Climate control commands may be based on both the occupancy status of the room (whether a person is present) and the expected occupancy status (whether a person is authorized or expected to be present), as described below.

Figure 2B:
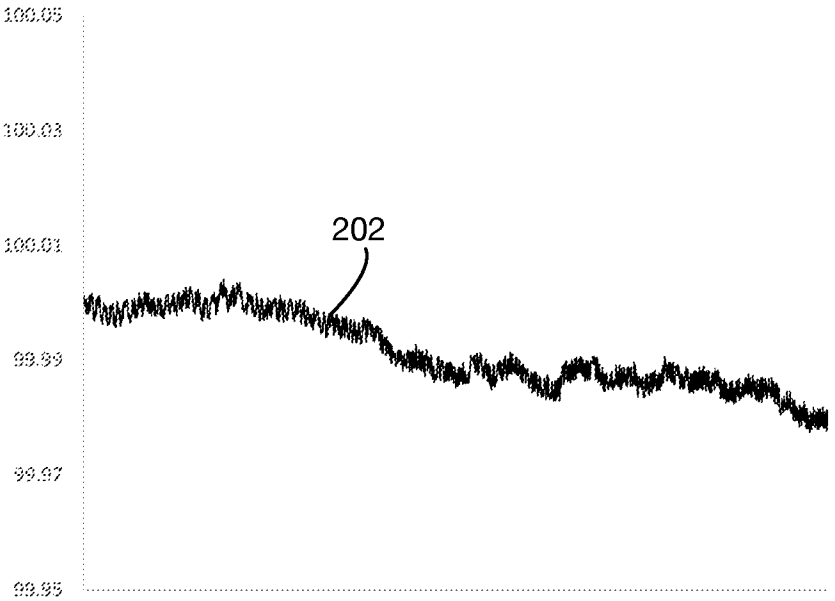
FIG. 2B shows illustrative barometer data from an occupied room.
Figure 2A:
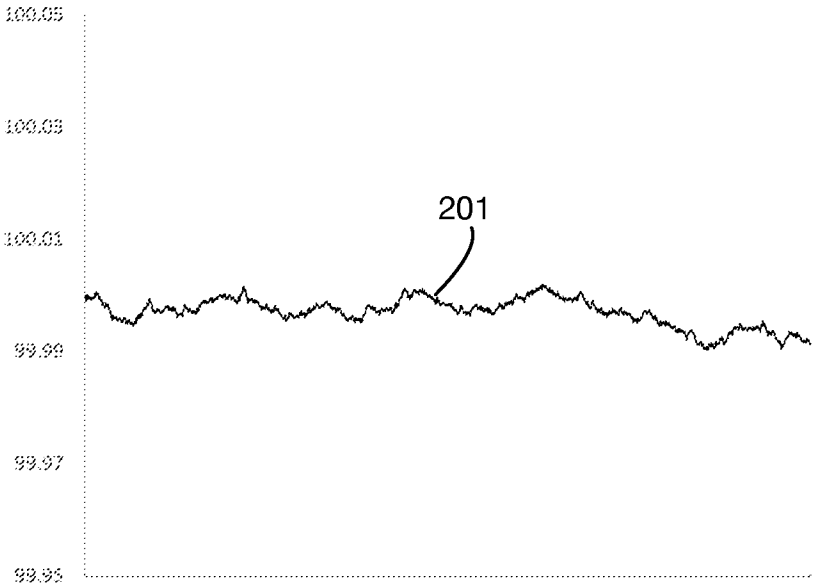
FIG. 2A shows illustrative barometer data from an unoccupied room.
Figure 3:
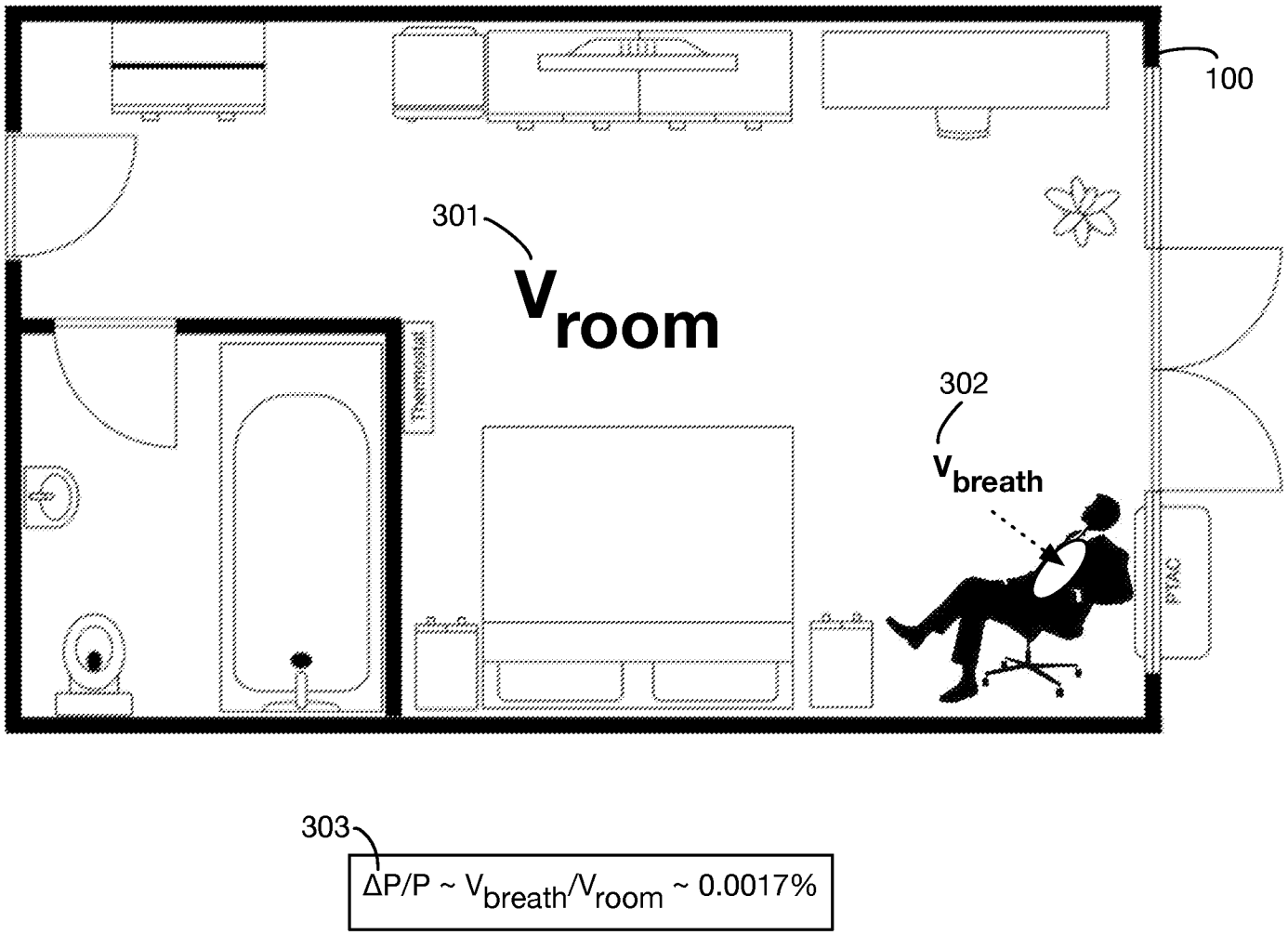
FIG. 3 shows the sensitivity of room pressure to breathing, indicating that the pressure changes due to breathing are very small but are still detectable.

FIGS. 2A, 2B, 3, and 4 show an illustrative method that may be used in one or more embodiments to determine occupancy from fluctuations in barometric sensor data. As a person breathes, the alternating inhalation and exhalation generates corresponding decreases and increases in room air pressure. While these fluctuations are small, they can be detected with a sensitive barometer. Using such an instrument, FIG. 2A shows an illustrative time series 201 of room barometric pressure for an unoccupied room, and FIG. 2B shows a corresponding time series 202 for an occupied room. With sufficient resolution, the breathing pattern present in time series 202 can be isolated and identified. FIG. 3 illustrates the magnitude of a typical barometric fluctuation due to breathing. The fractional change in room pressure due to breathing 303 is approximately proportional to the ratio of the volume of breath 302 (inhaled or exhaled) to the corresponding volume of air 301 in room 100. During a resting breathing cycle the typical volume of air that is inhaled is approximately 0.5 liters, the same is exhaled. The expected volume of a typical hotel room is approximately 58,900 liters, assuming 20% of the room is solid furniture. This implies that the fluctuation in air pressure is approximately 1 liter divided by 58,900 liters, or 0.0017%, which is a variation of 1.7 Pa for a typical ambient air pressure of about 100 kPa. An illustrative barometer that can measure this variation is an Infineon® DPS310, which has a precision of ±0.2 Pa. In one or more embodiments, the air pressure analysis algorithm may be configured with an estimated volume for each indoor space that is monitored.

Figure 4:
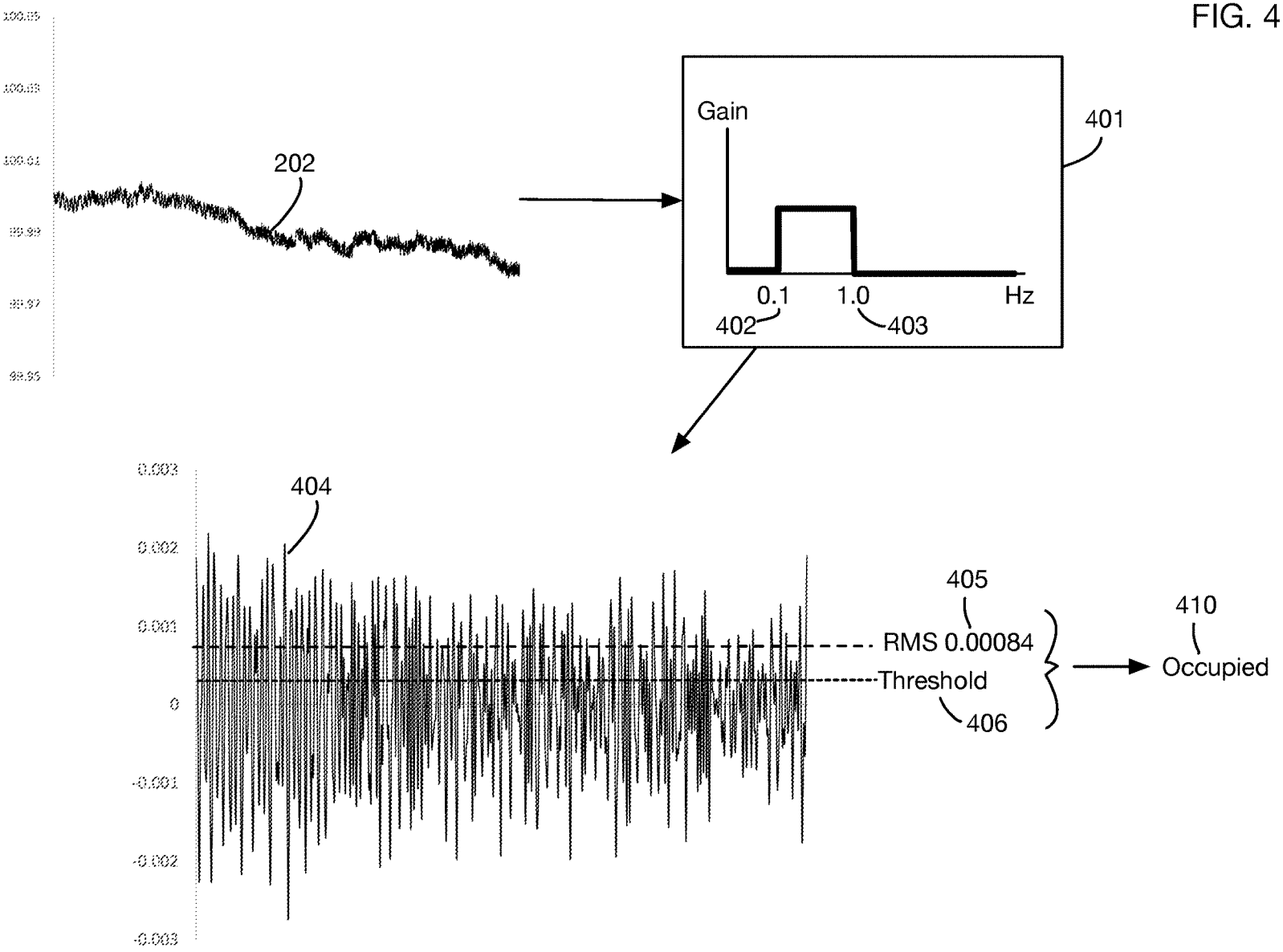
FIG. 4 shows an illustrative technique used in one or more embodiments to process barometer data using a bandpass filter that selects frequencies corresponding to breathing.

One or more embodiments may process the barometric pressure data to isolate the small fluctuations that may indicate human breathing. An illustrative processing method is shown in FIG. 4. In this example, the time series 202 is processed with a frequency filter 401 to isolate the frequencies that are typical for human breathing. Normal human respiratory rates are approximately as follows:

| Age | Respiratory Rate (breath/minute) | Breath Frequency (Hz) |
|---|---|---|
| birth to 1 year | 30 to 60 | 0.50 to 1.00 |
| 1 to 3 years | 24 to 40 | 0.40 to 0.67 |

-continued

| Age | Respiratory Rate (breath/minute) | Breath Frequency (Hz) |
|---|---|---|
| 3 to 6 years | 22 to 34 | 0.37 to 0.57 |
| 6 to 12 years | 18 to 30 | 0.30 to 0.50 |
| 12 to 18 years | 12 to 16 | 0.20 to 0.27 |
| adult | 12 to 20 | 0.20 to 0.33 |

Therefore normal breathing falls within a frequency range of 0.1 Hz to 1 Hz. The barometric data 202 may therefore be input into a bandpass filter 401 with a passband in this range 402 to 403. The signal magnitude of the resulting filtered signal 404 may be compared to one or more thresholds to determine whether the signal is indicative of breathing. Thresholds may be based for example on the ratio of estimated breath volume to estimated room volume, as described above. For example, the root mean square 405 of the signal 404 may be compared to a threshold value 406, and if it exceeds the threshold then the system may determine that the room is occupied 410. One or more embodiments may apply any type of test or threshold to signal 404 to check for occupancy, including but not limited to a comparison of a root mean squared value to a threshold. In one or more embodiments, tests or thresholds may be applied directly to the original signal 202, or to any measure of signal magnitude in the time domain or the frequency domain.

Filter 401 may be implemented using any signal processing technique or techniques known in the art. For example, IIR (Infinite Impulse Response) filtering may be used to mask higher frequency noise, and coefficients of the IIR filter may be tuned to select the desired frequency range 402 to 403. This filter may be implemented for example using integer math on a simple CPU.

Figure 5:
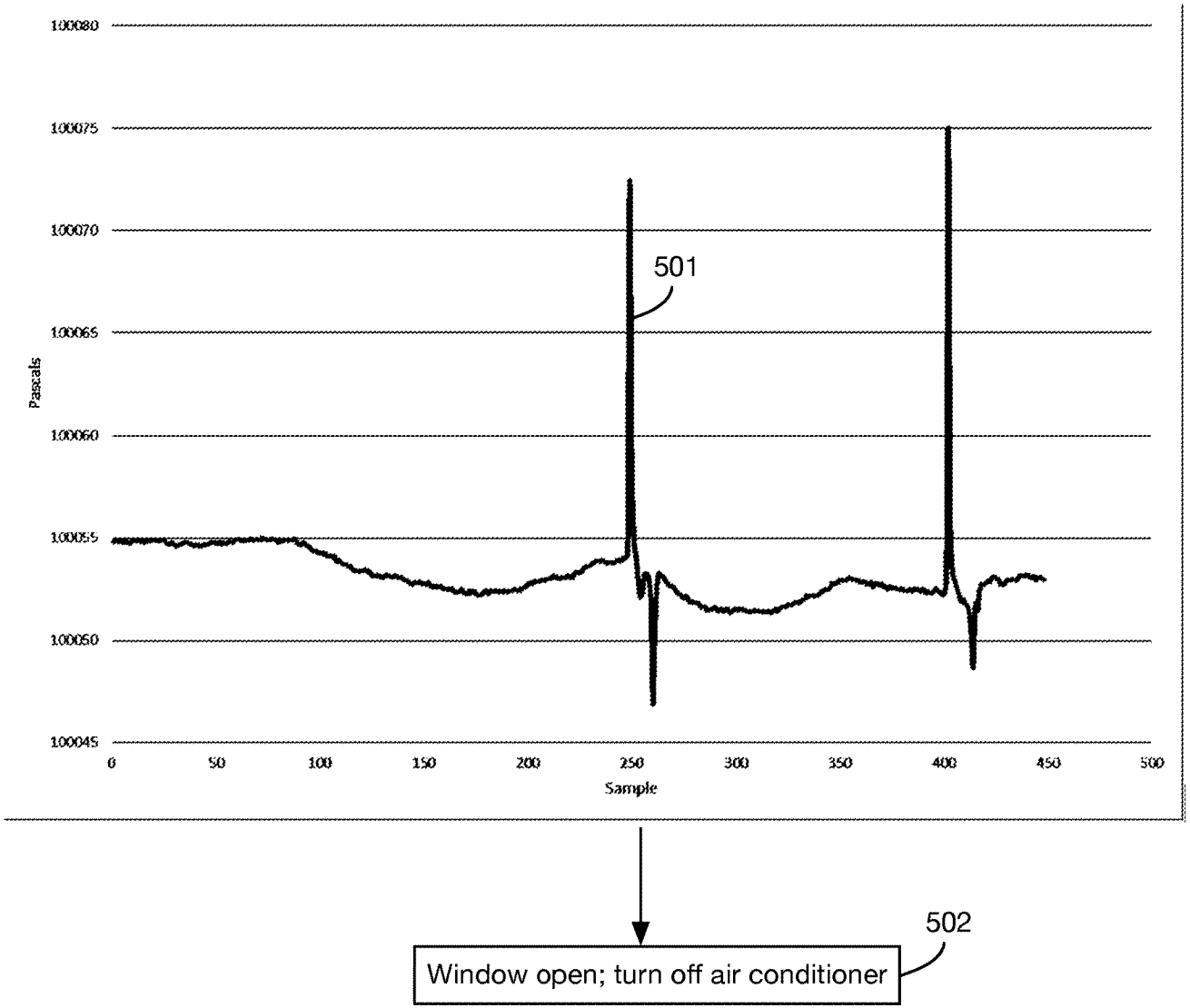
FIG. 5 shows illustrative barometer data that indicates the opening of a door or window.

In one or more embodiments, barometric pressure data may also be analyzed to detect when a door or window of the indoor space is opened or closed, or is opening or closing. FIG. 5 shows an illustrative example. Opening or closing of a door or window typically causes a spike 501 in pressure, which is very distinct compared to the pattern of breathing. A spike such as 501 is typically greater than 50 Pa within less than a second. The climate control system may respond to detection of these events; for example, a command 502 may turn off air condition when the barometric pressure data indicates that a window has been opened. The climate control system may also save the most recently detected state of a window or door, and this saved state may affect future climate control actions. For example, if the system determines that a window is open, then a future event (such as a guest checking in) that might normally trigger an action such as turning on an air conditioner or heater may instead have no effect or a different effect, since the climate control system may choose to not waste energy by heating or cooling a room with an open window.

Barometric data may also be used to determine the altitude of the room, since barometric air pressure has a direct relationship to altitude. This data may for example be used to ensure that sensors are associated with rooms correctly based on the altitude or floor number of each room.

Figure 6:
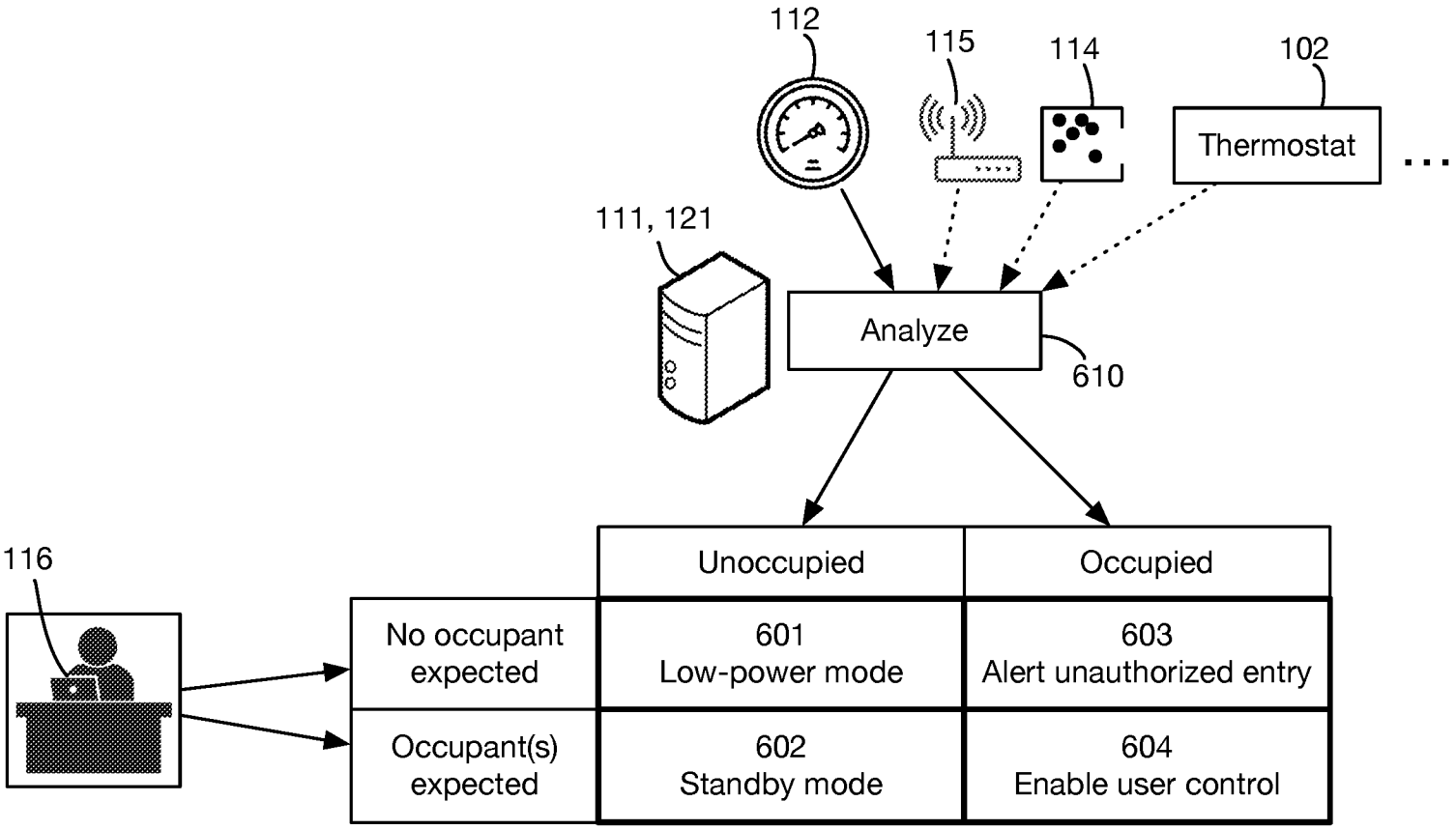
FIG. 6 illustrates combining occupancy status with expected occupancy status information and setting climate controls according to the combination of this information.

FIG. 6 shows illustrative climate control commands that may be generated based on a combination of occupancy status and expected occupancy status. As described above, data from a barometer 112, or from additional sensors such as a gas analyzer 114, a wireless signal detector 115, and user input devices such as thermostat 102, may be input into an analysis system 610 (which may execute on processors 111 or 121) that determines whether a room is unoccupied or occupied. In addition, a property management system 116 or other external system may provide information on whether one or more occupants are expected to be present during particular periods of time. For example, the property management system 116 may be a reservation system that projects time periods when the room may be reserved or rented. The property management system may be a front office system that records when guests check in and out, and the expected occupancy status of a room may be modified to "occupant expected" between a check in and check out. One or more embodiments may use any type of information to determine whether and during what time periods a room is expected to be potentially occupied, and may use any desired criteria to determine when occupancy is expected. For example, expected occupancy status may be determined based on reservation data, rental data, historical trends, models that predict usage of rooms, or any other factors. Expected occupancy status may be defined over any desired period of time; the "occupant expected" status may for example be interpreted as expectation of an occupant within a small time period (such as minutes) or a large time period (such as days or weeks). In one or more embodiments, expected occupancy may be a probabilistic measure of the likelihood that an occupant will occupy a room over or within some period of time. When the room is unoccupied, and no occupant is expected, commands 601 may put the climate control system into a low-power mode for energy savings. When the room is occupied but no occupant is expected, one or more embodiments may generate an alert 603 indicating that an unauthorized or unexpected person has entered the room. When the room is unoccupied but one or more occupants are expected, one or more embodiments may put the climate control system into a standby mode 602; in this mode the power consumption may be reduced, but only to a level where comfortable conditions can be restored quickly when someone enters the room. When the room is occupied and an occupant is expected, system may enable user climate control via command 604, for example by enabling a thermostat that can be set by a user (within limits defined by the facility). These actions are illustrative; one or more embodiments may generate any desired climate control commands based on any of the information from the sensors and from external systems like property management system 116.

Figure 7:
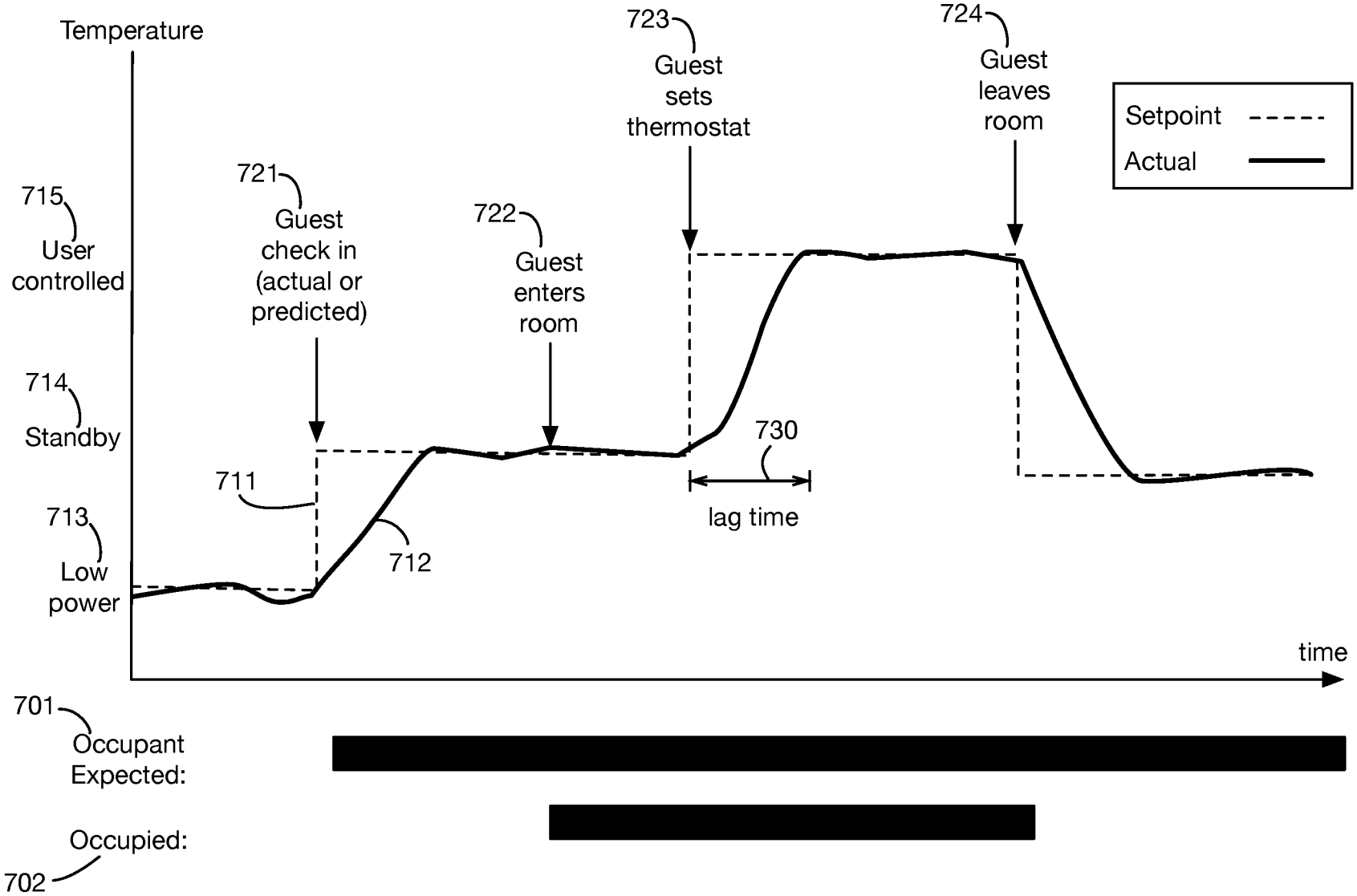
FIG. 7 shows an illustrative time sequence of occupancy and expected occupancy status and resulting changes in climate control settings.

FIG. 7 illustrates some of the actions shown in FIG. 6 based on a timeline of expected occupancy status 701 and occupied status 702. The setpoint temperature 711 generated by the control system is displayed along with the actual room temperature 712. Initially the room is unoccupied and no occupant is expected, so temperature control is set to a low power level 713. At time 721, expected occupancy status changes, for example due to a guest checking in or because a reservation system predicts imminent arrival of an occupant. The system at this point sets the temperature to a standby level 714. At time 722 a person enters the room, so the occupancy status changes to occupied, and user control of a thermostat is enabled. At time 723, the guest increases the desired temperature to level 715 using the thermostat. The standby level 714 is set so that the lag time 730 for actual temperature 713 to change to reach the guest's set value 715 is within an acceptable limit. This lag time may depend for example on factors such as the type or power of HVAC in the room, and the room's insulation; the standby level may be set based on these factors, which may be configured or learned by the system. The standby level 714 may therefore vary across rooms, based on these individual room characteristics. At time 724, the guest leaves the room, and the setpoint is returned to the standby level 714.

In one or more embodiments, an event such as event 722 when a room becomes occupied may trigger an automatic adjustment in the setpoint for the room temperature. For example, a property may define a desired "welcome" temperature that is set when a guest enters a room. This temperature may be for example a reasonably comfortable temperature that may be acceptable to most guests. In one or more embodiments, guests may be able to override this welcome temperature using manual control of a thermostat. The standby level 714 may be set such that the lag time to reach the welcome temperature level from the standby level is within a desired time limit. This standby level may vary by room, based for example on characteristics of the room and its HVAC system that affect how quickly temperature of the room responds to climate controls.

Figure 8:
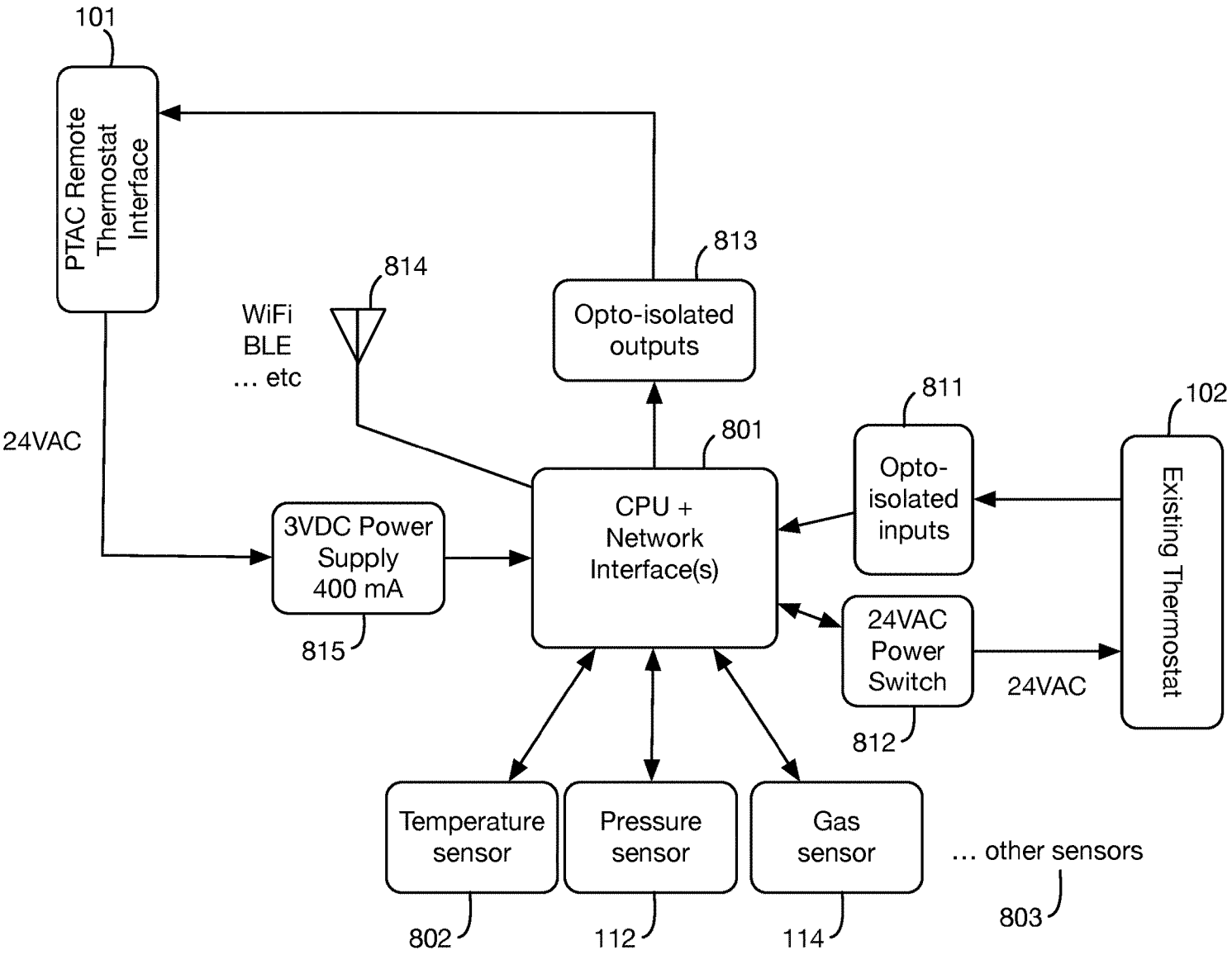
FIG. 8 shows a block diagram of an embodiment of the invention.

One or more embodiments of the invention may combine multiple components into an integrated hardware device, which may for example be connected easily to an existing room PTAC system or thermostat. FIG. 8 shows a block diagram of an illustrative embodiment that contains a CPU 801 with network interfaces, and sensors such as pressure sensor 112, a temperature sensor 802, a gas sensor 114, and possibly additional sensors 803. The CPU may be connected to opto-isolated outputs 813, which may for example be connected to a PTAC remote thermostat interface 101. It may also be connected to opto-isolated inputs 811, which may for example be connected to an existing wall-mounted thermostat 102. The device may include a power switch 812 that may be connected to the thermostat 102, and it may have a power connection 815 to PTAC interface 101. It may also include one or more wireless antennas 814 and corresponding communications interfaces, enabling communication over wireless links such as Wi-Fi or Bluetooth Low Energy.

Figure 9:
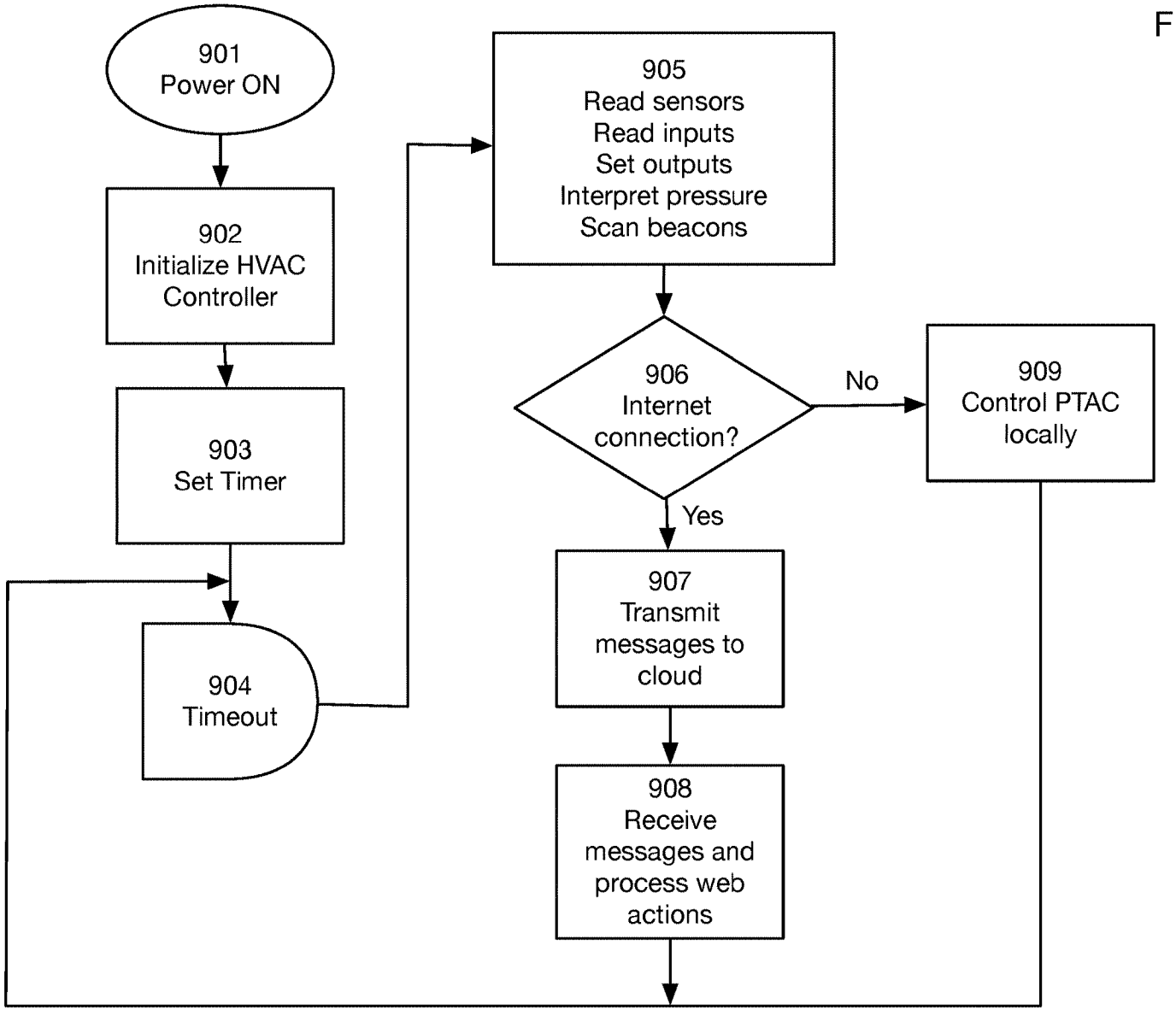
FIG. 9 shows a flowchart of a processing loop used in an embodiment of the invention that may use cloud-based computing resources to analyze sensor data.

The device illustrated in FIG. 8 may communicate with other processing and data resources, for example over Internet connections. Some or all of the data analysis may be performed in the cloud. FIG. 9 shows an illustrative flowchart of a processing loop that may use both the local resources of the in-room device and the cloud resources. After powering on in step 901, the controller performs initialization 902 and then sets a timer 903 that drives periodic processing of sensor data. For example, a timeout 904 may occur once per second (or at any desired frequency), initiating step 905 that reads data from all sensors. If test 906 indicates that the Internet connection to the cloud resources is active, data is transmitted to the cloud resources in step 907, and resulting messages and commands 908 are returned to the local controller. If no Internet connection is available, step 909 provides localized climate control.

In one or more embodiments the controller may also act as a general-purpose gateway, which may for example allow devices to communicate with the cloud or with other network-connected systems. For example, the controller may receive beacon signals from beacons carried by facility staff, so that the location of staff can be tracked throughout the facility. It may also receive panic alarms initiated by staff when they are in danger or discover emergency situations. Other sensors, such as for example a water leak sensor, may use the controller as a gateway to transmit alerts and information to the facility; this may for example allow for a quick response like shutting off water to the correct location.

While the invention herein disclosed has been described by means of specific embodiments and applications thereof, numerous modifications and variations could be made thereto by those skilled in the art without departing from the scope of the invention set forth in the claims.

What is claimed is:

1. A climate controller that determines occupancy status from barometric data, comprising;

a barometer configured to measure air pressure in an indoor space;

a processor coupled to said barometer and configured to receive air pressure data from said barometer;

analyze said air pressure data to determine an occupancy status of said indoor space, wherein said analyze said air pressure data comprises determine whether fluctuations in said air pressure data are indicative of one or more persons breathing in said indoor space;

transmit a control signal to a climate control system in or proximal to said indoor space, wherein said control signal is based on said occupancy status of said indoor space;

wherein said determine whether fluctuations in said air pressure data are indicative of said one or more persons breathing in said indoor space comprises apply a filter to said air pressure data to obtain a signal magnitude in a frequency range corresponding to human breath frequencies; and, compare said signal magnitude to a threshold, wherein said threshold is based on an estimated volume of said indoor space and on an estimated volume of a human breath.

2. The climate controller that determines occupancy status from barometric data of claim 1, wherein said climate control system comprises one or more of a heater, an air conditioner, a heat exchanger, a humidifier, a dehumidifier, a fan, a ventilation system.

3. The climate controller that determines occupancy status from barometric data of claim 1, wherein said indoor space comprises a room or suite of one or more of a hotel, a motel, a lodge, a bed-and-breakfast, a vacation rental, a timeshare, an apartment building, an office building.

4. The climate controller that determines occupancy status from barometric data of claim 1, wherein said control signal sets a power level of said climate control system to a low level when said occupancy status comprises unoccupied.

5. The climate controller that determines occupancy status from barometric data of claim 1, wherein said control signal enables a user-controllable thermostat when said occupancy status of said indoor space comprises occupied, and wherein said control signal disables said user-controllable thermostat when said occupancy status of said indoor space comprises unoccupied.

6. The climate controller that determines occupancy status from barometric data of claim 1, wherein said frequency range is between 0.1 Hertz to 1 Hertz.

7. The climate controller that determines occupancy status from barometric data of claim 1, wherein said processor is further coupled to a property management system;

said processor is further configured to receive an expected occupancy status associated with said indoor space from said property management system; and, said control signal is further based on said expected occupancy status associated with said indoor space.

8. The climate controller that determines occupancy status from barometric data of claim 7, wherein said control signal sets a power level of said climate control system to a low level when said occupancy status comprises unoccupied and when said expected occupancy status comprises no occupant expected; and, a standby level when said occupancy status comprises unoccupied and when said expected occupancy status comprises occupant expected.

9. The climate controller that determines occupancy status from barometric data of claim 8, wherein said standby level enables said climate control system to drive a temperature of said indoor space to a target temperature within a target period of time.

10. The climate controller that determines occupancy status from barometric data of claim 1, wherein said processor is further coupled to one or more additional sensors; and said processor is further configured to receive sensor data from said one or more additional sensors; and, determine said occupancy status of said indoor space based on said fluctuations in said air pressure and on said sensor data.

11. The climate controller that determines occupancy status from barometric data of claim 10, wherein said one or more additional sensors comprise one or more of a gas sensor, a user input device, a wireless network interface.

12. The climate controller that determines occupancy status from barometric data of claim 1, wherein said processor is further configured to analyze said air pressure data to determine a state of a window or door of said indoor space, wherein said state comprises one or more of an open state, a closed state, an opening state, a closing state.

13. The climate controller that determines occupancy status from barometric data of claim 12, wherein said control signal is further based on said state of said window or said door of said indoor space.

14. A climate controller that determines occupancy status from barometric data, comprising;

a barometer configured to measure air pressure in an indoor space;

a processor coupled to said barometer and coupled to a property management system, wherein said processor is configured to receive air pressure data from said barometer;

analyze said air pressure data to determine an occupancy status of said indoor space, wherein said analyze said air pressure data comprises apply a filter to said air pressure data to obtain a signal magnitude in a frequency range corresponding to human breath frequencies, wherein said frequency range is between 0.1 Hertz to 1 Hertz; and, compare said signal magnitude to a threshold, wherein said threshold is based on an estimated volume of said indoor space and on an estimated volume of a human breath;

receive an expected occupancy status associated with said indoor space from said property management system; and, transmit a control signal to a climate control system in or proximal to said indoor space, wherein said control signal is based on said occupancy status of said indoor space and on said expected occupancy status;

wherein said control signal enables a user-controllable thermostat when said occupancy status of said indoor space comprises occupied;

said control signal disables said user-controllable thermostat when said occupancy status of said indoor space comprises unoccupied;

said control signal sets a power level of said climate control system to a low level when said occupancy status comprises unoccupied and when said expected occupancy status comprises no occupant expected; and, a standby level when said occupancy status comprises unoccupied and when said expected occupancy status comprises occupant expected.

* * * * *